United States Patent [19]

Matthews

[11] 4,047,878

[45] Sept. 13, 1977

[54] ELECTRONIC CONTROL ARRANGEMENT FOR DETECTING A LEAK CONDITION FOR A VALVE

[75] Inventor: Russell Byron Matthews, Goshen, Ind.

[73] Assignee: Johnson Controls, Inc., Milwaukee, Wis.

[21] Appl. No.: 621,653

[22] Filed: Oct. 14, 1975

[51] Int. Cl.[2] ..... F23N 5/24

[52] U.S. Cl. ..... 431/22; 431/16

[58] Field of Search ..... 431/142, 143, 145, 146, 431/151, 178, 16, 22; 137/65, 66

[56] References Cited

U.S. PATENT DOCUMENTS

| | | | |
|---|---|---|---|
| 3,223,138 | 12/1965 | Brown | 431/16 |
| 3,273,019 | 9/1966 | Matthews | 431/69 |
| 3,488,131 | 1/1970 | Myers et al. | 431/69 |
| 3,583,842 | 6/1971 | Hancock et al. | 431/16 |
| 3,744,954 | 7/1973 | Faulkner | 431/22 |
| 3,840,322 | 10/1974 | Cade | 431/78 |
| 3,947,220 | 3/1976 | Dietz | 431/71 |

*Primary Examiner*—Edward G. Favors
*Assistant Examiner*—R. J. Charvat
*Attorney, Agent, or Firm*—Johnson, Dienner, Emrich & Wagner

[57] ABSTRACT

A control arrangement for use in an automatic fuel ignition system for providing electronic detection of a leak condition for a pilot valve operable to supply fuel to a pilot outlet for ignition to establish pilot flame includes a flame sensing circuit which effects operation of a main valve when a pilot flame is established, the flame sensing circuit maintaining the main valve deenergized when a pilot flame is established during an ignition interval and permitting a delay device to deenergize the pilot valve for a time to interrupt the supply of fuel to the pilot outlet to attempt to extinguish the pilot flame, and a time out device operable to deactivate the system when the delay device fails to cause the pilot flame to be extinguished, the flame sensing means overriding the delay device and the timeout device when the pilot flame is established at the end of the ignition interval.

14 Claims, 1 Drawing Figure

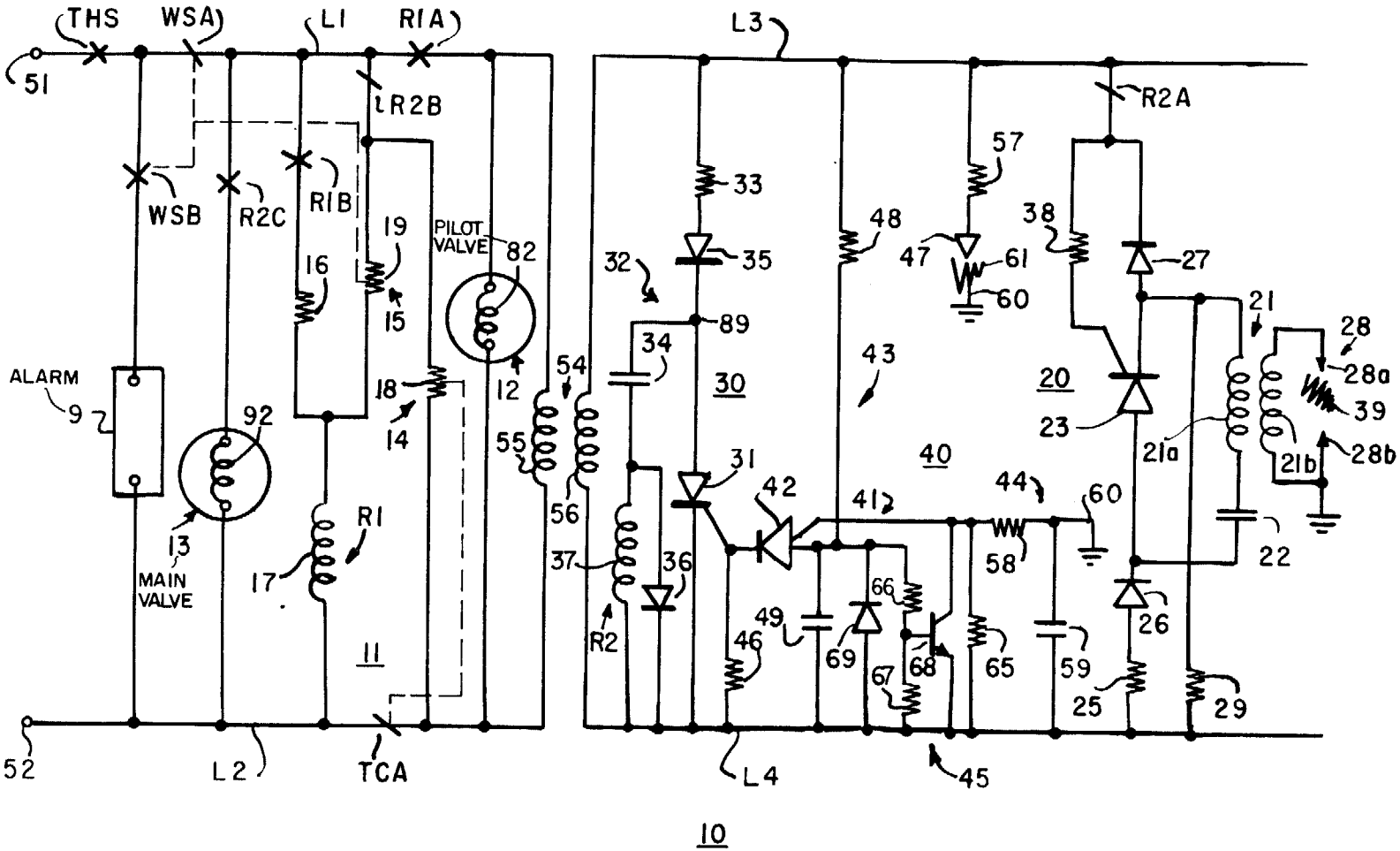
PILOT VALVE
MAIN VALVE
ALARM
THS
WSA
WSB
R1A
R2B
R1B
R2C
L1
L2
L3
L4
R2A
R1
R2
TCA
10
11
12
13
14
15
16
17
18
19
20
21
21a
21b
22
23
25
26
27
28
28a
28b
29
30
31
32
33
34
35
36
37
38
39
40
41
42
43
44
45
46
47
48
49
51
52
54
55
56
57
58
59
60
61
65
66
67
68
69
82
89
92

ELECTRONIC CONTROL ARRANGEMENT FOR DETECTING A LEAK CONDITION FOR A VALVE

BACKGROUND OF THE INVENTION

1. Field of the Invention

This invention relates to automatic fuel ignition systems, and more particularly, to an automatic fuel ignition system employing electronic leak detection for a valve.

2. Description of the Prior Art

Automatic fuel ignition systems include a control circuit which provides sequential operation of valves of the system. For example, in pilot ignition systems, the control circuit responds to a request signal, typically the application of power to the control circuit in response to operation of a thermostatically-controlled switch, to effect the operation of a pilot valve to supply fuel to a pilot outlet. The control circuit also enables an ignition circuit to generate ignition sparks for igniting the fuel to establish a pilot flame. When a pilot flame is established, the control circuit operates a main valve which supplies fuel to a main burner for ignition by the pilot flame.

In such systems the presence or absence of a flame at the pilot outlet is generally used to effect the sequencing operations provided by the control circuit and to enable various checks to assure fail-safe operation of the system to prevent inadvertant operation of the pilot and main valves. Thus, a leak condition for the pilot valve, for example, could interrupt the normal sequencing operations of the system which permit fail-safe operation of the system. Moreover, for a leak condition for the pilot valve, fuel will be continously supplied to the pilot outlet, wasting fuel and producing a potentially hazardous condition.

In the U.S. Pat. No. 3,840,322 of Philip J. Cade, there is disclosed electrical control circuitry for use in an automatic fuel ignition system and which is operable to effect lock out of the system whenever a pilot flame is provided at a burner prior to the operation of a fuel valve of the system, indicative of a leak condition for the pilot valve. However, the system does not provide for a restart of the ignition interval upon detection of such condition. Thus, in the event of a line voltage interruption of a very short duration, wherein the pilot flame may not be extinguished before power is restored to the system, the system may be locked out. Accordingly, for such condition, manual reset of the system would be required before the system can be reactivated, even though the pilot valve may be functioning properly.

Thus, it would be desirable to have an automatic fuel ignition system which automatically distinguishes between a leak condition for the pilot valve and a line voltage interruption which permits the pilot flame to remain established upon momentary deactivation of the system, and which permits recycling of the system following a fast line interruption, but effects the shut down of the system for a leak condition for the valve.

SUMMARY OF THE INVENTION

It is, therefore, an object of the present invention to provide a control arrangement for electronically detecting a leak condition for a valve.

Another object of the invention is to provide an automatic fuel ignition system including a control arrangement which automatically responds to a leak condition for a fuel valve of the system to effect the shut down of the system in the event of such condition.

Another object of the invention is to provide an automatic fuel ignition system including a control arrangement which automatically responds to a line voltage interruption of a very short duration, which permits the pilot flame to remain established, to permit recycling of the system when power is restored, thereby preventing a lock out condition for the system.

It is another object of the invention to provide a fail-safe control circuit for an automatic fuel ignition system including a pilot valve and a main valve, which prevents the operation of the main valve in the event of leak condition for the pilot valve.

These and other objects are achieved by the present invention which has provided a control arrangement for use in an automatic fuel ignition system for electronically detecting a leak condition for a valve means employed in a control system, and for effecting the deactivation of the system for such condition.

The control arrangement automatically distinguishes between a flame established as the result of a leak condition for a valve means and a flame which has remained established as the result of a momentary loss of power to the system. In the event a flame is established prior to activation of the system, the valve means is deactivated for a short duration during the ignition cycle. Thus, if a flame has been established as the result of a fast line voltage interruption, the flame will be extinguished and normal operation of the system ensues without lockout. On the other hand, if the flame is established as the result of a leak condition for the valve means, deenergizing the valve means is ineffective to cause the flame to be extinguished and the system will become locked out at the end of the ignition interval.

In accordance with a disclosed embodiment, the control arrangement is employed to detect a leak condition for a pilot valve means of the fuel ignition system. The pilot valve means is operable when energized to supply fuel to a fuel outlet during an ignition interval for ignition to establish a pilot flame. The control arrangement includes flame sensing means for sensing the presence of a pilot flame, control means operable in the absence of a pilot flame during a first duration following the start of the ignition interval to energize a main valve means for supplying fuel to the fuel outlet for ignition by the pilot flame. The control means is operable to maintain the main valve means deenergized whenever a pilot flame is established during the first duration. For such condition, a delay device effects deenergization of the pilot valve means for a pedetermined time to attempt to extinguish the pilot flame.

If the pilot flame is extinguished as the result of operation of the delay means, the flame sensing means enables the control means to effect energization of the main valve means and the disabling of the delay means. On the other hand, if the operation of the delay means fails to extinguish the pilot flame, indicative of a leak condition ,or the pilot valve, a timeout means deactivates the system at the end of the ignition interval.

Thus, for a condition which appears to be a leak condition for the pilot valve means, the control arrangement of the present invention permits momentary deenergization of the pilot valve means to attempt to extinguish the flame and in the event the flame is extinguished, an ignition cycle is initiated without lockout of the system. Accordingly, a momentary power loss, which permits the pilot flame to remain established while the pilot valve means and the main valve means are deenergized momentarily, does not cause the system to be locked out. The control arrangement of the present invention also provides 100% lockout for any type of a circuit component failure, including the failure of the pilot flame to be established.

DESCRIPTION OF THE DRAWING

The single FIGURE, which is the only drawing of the application, is a schematic circuit diagram of a control circuit for an automatic fuel ignition system provided by the present invention.

DESCRIPTION OF A PREFERRED EMBODIMENT

Referring now to the drawing, there is shown a schematic circuit diagram for an automatic fuel ignition system 10 provided by the present invention. The fuel ignition system 10 includes a control circuit 11 including a control relay R1 which is energized in response to operation of a thermostatically-controlled switch THS to effect the operation of a pilot valve 12 for supplying fuel to a pilot outlet (not shown). The control circuit 11 also includes a delay device, embodied as a thermal cycler 14, which is operable under certain conditions to permit momentary deenergization of the pilot valve 12 at a predetermined time after the control circuit 11 is energized to enable a check for a leak condition for the pilot valve 12. A timeout device, embodied as a warp switch 15 permits deactivation of the system 10 and the enabling of an alarm device 9 in the event of a malfunction of the system 10, including a leak condition for the pilot valve 12.

The fuel ignition system 10 further includes a pilot ignition circuit 20 which is of the capacitor discharge type, having an ignition transformer 21, a capacitor 22, which is periodically charged to predetermined value, and a controlled switching device, embodiment as a silicon controlled rectifier 23, operable to discharge the capacitor 22 over the ignition transformer 21 to effect the generation of ignition sparks between ignition electrodes 28, which are located adjacent a pilot outlet (not shown), for igniting fuel suppled to the pilot outlet to establish a pilot flame.

An energizing circuit 30 controls the energization of a relay R2 to effect the operation of a main valve 13 whenever a pilot flame is established to supply fuel to the main burner apparatus (not shown) for ignition by the pilot flame. The energizing circuit 30 also maintains the main valve 13 operated as long as the pilot flame remains established. The energizing circuit 30 includes a controlled switching device 31, embodied as a silicon controlled rectifier, and a timing network 32, including a resistor 33 and capacitor 34.

The energizing circuit 30 is operable to periodically charge and discharge the capacitor 34 of the timing network 32 under the control of the silicon controlled rectifier 31. The timing network 32, including the capacitor 34, is connected between conductors L3 and L4. Whenever the silicon controlled rectifier 31 is non-conducting, the capacitor 34 is charged by an AC signal provided over conductors L3 and L4. When the silicon controlled rectifier 31 is enabled, the capacitor 34 is discharged through the operate coil 37 of the relay R2. Energy can only be stored by the capacitor 34 if the silicon controlled rectifier 31 is not conducting for a portion of each cycle of the AC signal.

For the purpose of enabling the silicon controlled rectifier 31 to effect the discharge of the capacitor 34, the fuel ignition system 10 further includes a flame sensing circuit 40 which senses the pilot flame and provides enabling pulses for the silicon controlled rectifier 31 during each cycle of the AC signal once the pilot flame is established.

The flame sensing circuit 40 includes a pulse generating circuit 41 comprised of a controlled switching device 42 and associated timing networks 43 and 44 which control the enabling of the controlled switching device 42 such that prior to the establishment of a pilot flame, the silicon controlled rectifier 31 is maintained non-conducting permitting capacitor 34 to store sufficient energy to operate relay R2 when the silicon controlled rectifier conducts, permitting capacitor 34 to discharge over the relay R2.

When the pilot flame is established, the flame sensing circuit 40 responds to the AC signal to enable the silicon controlled rectifier 31 at a predetermined time after the start of each cycle of the AC signal. The timing networks 43 and 44 establish the turnon time for the controlled switching device 42 which permits the silicon controlled rectifier 31 to be enabled to permit the capacitor 34 to discharge over the relay coil 37 at a time during each cycle before the capacitor 34 is fully charged, but has charged to a value sufficient to maintain the relay R2, and thus the main valve 13 operated.

Briefly, in operation, when thermostatically-controlled contacts THS close, the thermal cycle 14 and the warp switch 15 and the operate coil 17 of relay R1 are energized. When relay R1 operates, the pilot valve 12 is operated to supply fuel to the pilot outlet, and the ignition circuit 20 is energized to effect the generation of ignition sparks at electrodes 28 for igniting the fuel supplied to the pilot outlet. In addition, the energizing circuit 30 permits the capacitor 34 to charge.

When the pilot flame is established, the flame sensing circuit 40 causes capacitor 34 to discharge over the operate coil 37 of the relay R2, and relay R2 operates to deenergize the warp switch 15 and the thermal cycler 14, and to energize the main valve 13 to permit fuel to be supplied to the main burner apparatus for ignition by the pilot flame. The energizing circuit 30 then maintains the main valve 13 operated until contacts THS are opened or a flame out condition occurs in which case, a trial for reignition of a pilot flame is initiated.

In accordance with the present invention, the automatic fuel ignition system 10 electronically detects a leak condition for the pilot valve 12 and permits the system 10 to be deactivated whenever a leak condition is detected for the valve 12.

In the event of a leak condition for the pilot valve 12 which permits fuel to be supplied to the pilot burner, the pilot flame remains lit when the system is deactivated. Accordingly, the next time switch THS operates to activate the system, relay R1 operates as described above to energize the energizing circuit 30 and the flame sensing circuit 40. However, since the pilot flame is established when the system is activated, flame sensing circuit 40 responds to the AC signal applied to conductors L3 and L4 and the pilot flame to enable the silicon controlled rectifier 31 early during each cycle of the AC signal thereby limiting the charging of capacitor 34 and preventing operation of relay R2. Accordingly, after a predetermined time, the warp switch 15 effects shut down of the system 10, and energization of the alarm device 9.

The thermal cycler 14 permits the control circuit 11 to distinguish between a leak condition for the pilot valve 12 and a line voltage interruption of a very short duration, in which the pilot flame has not been extinguished when power is resumed. In such case, the thermal cycler 14, which is energized upon the closing of switch THS, deenergizes the pilot valve 12 at a predetermined time after switch THS operates, and before the warp switch 15 is operable to deactivate the system, and maintains the pilot valve 12 deenergized for a time interval long enough for the pilot flame to be extinguished. After such time interval, the thermal cycler 14 reenergizes the pilot valve 12 and a trial for ignition is initiated in the normal manner.

Considering the automatic fuel ignition system in more detail, the system 10 has a pair of input terminals 51 and 52 which are connectable to a 24 VAC source for supplying power to the system 10. Terminal 51 is connected over normally closed contacts WSA of the warp switch 15 to a conductor L1 and terminal 52 is connected directly to a conductor L2.

The resistance element 18 of the thermal cycler 14 has one end connected over normally closed contacts R2B of relay R2 to conductor L1 and its other end connected over normally closed contacts TCA of thermal cycler to conductor L2, and is thus energized whenever contacts THS are operated to close.

The heater 19 of the warp switch 15 and the operate coil 17 of relay R1 are connected in series between conductors L1 and L2 over normally closed contacts R2B of relay R2 for energization whenever switch THS operates. A holding path is provided for relay R1 over a resistor 16 and normally open contacts R1B of relay R1 when closed when relay R1 operates.

The operate coil 82 of the pilot valve 12 is connected at one end over normally open contacts R1A of relay R1 to conductor L1 and over normally closed contacts TCA of the thermal cycler 14 to conductor L2, and is energized whenever contacts R1A are operated to close to operate the pilot valve 12 to supply fuel to the pilot burner for ignition to establish a pilot flame.

The operate coil 92 of the main valve 13 is connected over normally open contacts R2C of relay R2 between conductors L1 and L2 and is energized whenever relay R2 is operated to operate the main valve 13 to supply fuel to the main burner apparatus for ignition by the pilot flame.

In addition, for the purpose of extending power to conductors L3 and L4 for energizing the ignition circuit 20, the energizing circuit 30 and the flame sensing circuit 40, a power transformer 54 has a primary winding 55 having one end connected over normally open contacts R1A of relay R1 to conductor L1 and another end connected to conductor L2 over normally closed contacts TCA to be energized whenever relay R1 operates to close contacts R1A. A secondary winding 56 of the transformer 54 is connected between conductors L3 and L4. The transformer 54 may be a step-up transformer so that upon energization of the primary winding 55 with 24 VAC, signal 120 VAC power is supplied to conductors L3 and L4 over the secondary winding 56.

Referring now to the ignition circuit 20, the capacitor 22 is connected in a series charging circuit which extends from conductor L4 over a resistor 25, a diode 26, the capacitor 22, the primary winding **21*a* of the ignition transformer 21, a diode 27, and normally closed contacts R2A of relay R2 to conductor L3. The silicon controlled rectifier 23 is connected in shunt with a primary winding 21*a* of the ignition transformer 21 and capacitor 22. The gate electrode of the silicon controlled rectifier 23 is connected over a resistor 38 and contacts R2A to conductor L3. A resistor 29 is connected from the cathode of the silicon controlled rectifier 23 to conductor L4. The ignition electrodes 28, include a pair of electrodes 28*a* and 28*b* which are connected to opposite ends of the secondary winding 21*b* of the ignition transformer 21, and disposed adjacent the pilot outlet in a spaced relationship, providing a gap 39** therebetween.

Ignition electrode **28*b*** is connected to a ground reference point, which may, for example, be a metallic ground provided by the pilot burner or the main burner apparatus.

In operation, whenever AC power is applied to conductors L3 and L4 in response to the closing of contacts THS and the operation of relay R1, the capacitor 22 is charged during negative half cycles of the AC signal, that is, when conductor L4 is positive relative to conductor L3, over the charging path between conductors L4 and L3, which is established over resistor 25, diode 26, capacitor 22, winding **21*a*. diode 27 and contacts R2A when relay R2** is not operated.

During positive half cycles, that is, when conductor L3 is positive relative to conductor L4, the silicon controlled rectifier 23 is rendered conductive in response to current flow from conductor L3 over resistor 38, the gate-cathode circuit of the silicon controlled rectifier 23 and resistor 29 to conductor L4 permitting capacitor 22 to discharge through winding **21*a* such that the capacitive discharge current causes a voltage pulse to be induced in the secondary winding 21*b* which is applied to the ignition electrodes 28** generating a spark for igniting the pilot gas supplied to the pilot outlet to establish a pilot flame.

Referring to the flame sensing circuit 40, the controlled switching device 42 is embodied as a programmable unijunction transistor (PUT), such as the type 2N6028, commercially available from Motorola. The timing network 43, including resistor 48 and capacitor 49, serves as an anode control network for the PUT device 42, and the timing network 44, including resistors 57 and 58 and a capacitor 59, serves as a gate control network for the PUT device 42.

The flame sensing circuit 40 further includes a flame sensing electrode 47 connected over resistor 57 to conductor L3. The electrode 47 is positioned in a spaced-relationship with a ground reference point 60 for the fuel ignition system 10, normally providing a high resistance path, virtually an open circuit, between conductor L3 and the reference point 60. The ground reference point 60 may, for example, be a metallic ground provided by a gas burner apparatus or the pilot burner. The flame sensing electrode 47, is located in the region in which the pilot flame is to be produced such that the pilot flame bridges the gap 61 between the electrode 47 and the reference point 60 thereby lowering the resistance of the current path over the electrode 47 between conductor L3 and the reference point 60 whenever the pilot flame is established. The flame sensing electrode 47 and resistor 58 form a portion of the gate control network 44 for the PUT device 42.

The gate control network 44 determines the gate potential for the normally non-conducting PUT device 42. The gate control network 44 includes capacitor 59 which is connected between the reference point 60 and conductor L4. Whenever the pilot flame bridges the gap 61 between the sensing electrode 47 and the reference point 60, the resistance of the charging path for capacitor 59 is reduced, and capacitor 59 charges.

The gate control network 44 further includes resistor 58, which is connected between the reference point 60 and the gate electrode of the PUT device 42, and resistor 65, which is connected between the gate electrode of the PUT device 42 and conductor L3. Resistors 58 and 65 form a bleeder path for capacitor 59.

In addition, resistors 66 and 67, which are serially connected from the anode electrode of the PUT device 42 to conductor L4, and a transistor 68, having its collector-emiter circuit connected between the gate electrode of the PUT device 42 and conductor L4, and its base connected to the junction of resistors 66 and 67, form an over signal clamping circuit 45 to normally limit the voltage swing at the gate of the PUT device 42 to a predetermined amount.

The potential at the anode electrode of the PUT device 42 is determined by the anode control network 43. The anode control network 43 includes capacitor 49 which is connected between the anode electrode of the PUT device 42 and conductor L4. The anode control network 43 further includes resistor 48 which is connected between conductor L3 and the anode electrode of the PUT device 42 and thus to one side of capacitor 49. Accordingly, a charging path is provided for capacitor 49 from conductor L3 over resistor 48 and capacitor 49 to conductor L4. A diode 69, which is connected in parallel with capacitor 49 provides a by-pass path for capacitor 49 during negative half cycles of the AC signal whenever the PUT device 42 is not rendered conductive to discharge the capacitor 49.

The PUT device 42 is rendered conductive whenever the potential at the anode electrode exceeds the potential at the gate electrode by approximately 0.6 volts as determined by the action of the anode control network 43 and the gate control network 44. For the condition where the pilot flame is not established, the PUT device 42 conducts at a time when capacitor 49 stores low energy. When the pilot flame is established, the PUT device 42 conducts at a time when the capacitor 49 stores a greater amount of energy, which is sufficient to render the silicon controlled rectifier 31 conductive.

Whenever the PUT device 42 is rendered conductive, a discharge path is provided for capacitor 49 over the anode-cathode circuit of the PUT device 42 which supplies pulses provided by the flame sensing circuit 40 to the gate electrode of silicon controlled rectifier 31 of the energizing circuit 30.

With reference to the energizing circuit 30, the timing network 32 includes a diode 35, resistor 33, capacitor 34 and a diode 36, which are connected in series between conductors L3 and L4 forming a series unidirectional charging path for capacitor 34. The operate coil 37 of relay R3 is connected between one side of capacitor 34 at point 88 and conductor L4. The silicon controlled rectifier 31 has its anode connected to the other side of capacitor 34 at point 89 and its cathode connected to conductor L4. The gate electrode of the silicon controlled rectifier 31 is connected to the output of the flame sensing circuit 40 at the cathode of the PUT device 42, and over a resistor 46 to conductor L4.

The silicon controlled rectifier 31 is normally nonconducting and thus enables capacitor 34 to be charged during positive half cycles of the AC signal on conductors L3 and L4. The silicon controlled rectifier 31 is operable when enabled by pulses provided by the flame sensing circuit 40 in response to the pilot flame to provide a shunt path for capacitor 34 and the operate coil 37 of the relay R2, permitting the capacitor 34 to discharge over the coil 37. Typically, the capacitor 34 charges for approximately three cycles of the AC signal before the capacitor 34 is discharged over the operate coil 37 of the relay R2. The capacitor 34 charges to the peak value of the AC signal and thus stores sufficient energy to operate the relay R2.

Relay R2 may comprise an AC relay having a low coil resistance of approximately 800 ohms so that the capacitor 34 can provide sufficient discharge to effect energization of the relay R2. Relay R2, which is normally de-energized, has normally open contacts R2C, which are connected in series with the operate coil 92 of the main valve 13 between conductors L1 and L2, to permit operation of the main valve 13. In addition, relay R2 has normally closed contacts R2B connected in series with the energizing paths for the warp switch 15 and the thermal timer 14 to deenergize the warp switch 15 to prevent the system 10 from being locked out, and to deenergize the thermal timer 14. Further, normally closed contacts R2A of relay R2 are operable to deenergize the ignition circuit 20 when a pilot flame is established.

OPERATION

For the purpose of illustrating the operation of the automatic fuel ignition system 10, it is assumed that contacts THS are open so that the control circuit 11 is initially deenergized such that relays R1 and R2 are unoperated, and the main valve 13 and the pilot valve 12 are deenergized.

When contacts THS operate, extending the 24 VAC signal to conductors L1 and L2, current flows from conductor L1 over normally closed contacts R2B of relay R2 to energize the warp switch heater 19, the heater 18 of the thermal cycler 14, and the operate coil 17 of relay R1.

When relay R1 operates, contacts R1A to close, energizing the operate coil 82 of the pilot valve 12, which opens to supply fuel to the pilot burner. Also, contacts RIB close to provide a holding path over resistor 16 for relay R1. When contacts R1A close, the primary winding 55 of supply transformer 54 is energized, supplying 120 VAC power to conductors L3 and L4 to energize the ignition circuit 20 which is operable in the manner described above to effect the generation of ignition sparks between the ignition electrodes 28 for igniting the fuel supplied to the pilot outlet to establish a pilot flame. p Assuming initially that the pilot flame is extinguished, then when conductor L3 begins to swing positive current flows over the charging network 32 from conductor L3 over resistor 33, diode 35, capacitor 34 and diode 36, charging the capacitor 34. Capacitor 49 of timing circuit 43 also charges during the positive half cycle of the AC signal, supplying a potential to the anode of the PUT device 42. In the absence of a pilot flame, capacitor 59 remains discharged, and the PUT device 42 conducts early in the positive half cycle of the AC signal and before capacitor 49 has charged to a value sufficient to trigger the silicon controlled rectifier 31 into conduction. Thus, the silicon controlled rectifier 31 remains off, permitting capacitor 34 to charge. In normal operation, capacitor 34 is charged for approximately three cycles of the AC signal to the peak value of the amplitude of the AC signal supplied over conductors L3 and L4.

When the pilot flame is established, then during the next positive half cycle of the AC signal applied between conductors L3 and L4, when conductor L3 swings positive relative to conductor L4, current flows from conductor L3 through resistor 57, over sensing electrode 47 and the pilot flame to the reference point 60, and over capacitor 59 to conductor L4, permitting capacitor 59 to charge. The voltage across capacitor 59, which is connected over resistor 58 to the gate electrode of the PUT device 42, establishes a gate potential for the PUT device 42.

During the same half cycle, capacitor 49 is charged over a path extending from conductor L3 over resistor 48 and capacitor 49 to conductor L4, establishing a potential at the anode electrode of the PUT device 42.

The values of capacitors 49 and 59 are selected such that some time before the peak of the AC line voltage during the first half cycle of the AC line signal, the anode to gate potential of the PUT device 42 exceeds +0.6 volts so that the PUT device 42 is rendered conductive, permitting capacitor 49 to discharge over the PUT device 42. Also, at such time, capacitor 49 is charged to a voltage sufficient to effect the generation of a voltage pulse across the resistor 46 capable of rendering the silicon controlled rectifier 31 conductive. The speed of response of the flame sensing circuit 40 is a function of the value of capacitor 59 and resist,ors 58 and 65 which form the bleeder path for capacitor 59.

It should be understood that the only time pulses are supplied to the gate of the silicon controlled rectifier 31 is when the voltage at the anode electrode at the PUT device 42 exceeds that of the gate electrode +0.6 volts, and the silicon controlled rectifier 31 is enabled only when the capacitor 49 has charged sufficiently to provide the pulse energy required to render the silicon controlled rectifier 31 conductive.

When the silicon controlled rectifier 31 is rendered conductive, a discharge path is provided for capacitor 34 over the operate coil 37 for relay R2 which then operates to close contacts R2C to energize the main valve 13. In addition, contacts R2B open to de-energize the thermal timer 14 and the warp switch heater 19 and contacts R2A open to deenergize the ignition circuit 20. Relay R1 remains energized over its holding path over contacts R1B and resistor 16.

It is pointed out, once the pilot flame has been established and bridges the gap between the sensing electrode 47 and the reference point 60, the flame sensing circuit 40 provides enabling pulses to the gate of the silicon controlled rectifier 31 during each positive half cycle of the applied AC line signal. Prior to the enabling of the silicon controlled rectifier 31, the capacitor 34 charges to a value, typically 10 volts, which is sufficient to maintain the relay R2 operated when the capacitor 34 is discharged.

During negative half cycles of the AC line signal, when conductor L4 swings positive relative to conductor L3, the silicon controlled rectifier 31 is cut off. However, relay R2 is maintained energized by the free wheeling diode 36 during the time the silicon controlled rectifier 31 is non-conductive. The transfer of energy from capacitor 34 to relay R2 takes place every cycle as long as the pilot flame is established.

When the heat demand has been met, contacts THS open, deenergizing the system 10, causing relays R1 and R2 to be deenergized and permitting the main valve 13 and the pilot valve 12 to close so that the main burner flame and the pilot burner flame are extinguished.

In the event of a leak condition for the pilot valve 12, then when the system 10 is deenergized, the pilot flame remains established. Accordingly, the next time the system 10 is activated in response to operation of switch THS; with the presence of the pilot flame, the flame sensing circuit 40 is effective to maintain relay R2 deenergized.

As indicated above, for normal operation, whenever a pilot flame is established, the charging of capacitor 59 causes the PUT device 42 to be maintained non-conducting for a longer time to permit capacitor 49 to be charged to a voltage sufficient to trigger the silicon controlled rectifier 31 into conduction. The time constant of timing network 43, that is, resistor 48 and capacitor 49, is chosen so that the PUT down 42 and thus the silicon controlled rectifier 31 are maintained non-conducting for the first ¼ cycle of the AC signal, but are enabled at a time early in the positive half cycle. The time constant of timing network 32 of the energizing circuit 30 is chosen to be shorter than the time constant of timing network 43. When the silicon controlled rectifier 31 is rendered conductive during each cycle of the AC signal when the pilot flame is established, the charging of capacitor 34 is limited to a low value, such as 10 volts, which voltage provides sufficient discharge current for maintaining the relay R2 operated, but is insufficient to operate the relay R2. Accordingly, for the condition where a pilot flame is established at the time the system 10 is activated, relay R2 to prevented from operating, and the warp switch heater 19 continues to be energized, and warp switch contacts WSA operate to deactivate the system 10 and contacts WSB operate to energize the alarm device 9. Thus, in the event of leak condition for the pilot valve 12, the main valve 13 is not energized, and the system 10 locked out after the delay provided by the warp switch 15.

In the event of a line voltage interruption of a very short duration which causes momentary deenergization of relays R1 and R2, the pilot valve 12, and the main valve 13, the pilot flame may not be extinguished before the restoration of power occurs. To prevent lockout of the system for such condition, the thermal cycler 14 is operable to deenergize the pilot valve momentarily at a time after power is applied to the system 10, and before the warp switch 15 is operable to deactivate the system. When power is reapplied to the circuit following a fast line interruption, the warp switch heater 19 and the heating element 18 of the thermal cycler 14 are energized. Relay R1 also operates to close contacts R1A to energize the pilot valve winding 82. After a delay, which may be on the order of five seconds, as determined by the heating time of the thermal cycler 14, normally closed contacts TCA are opened, deenergizing the pilot valve 12 and the heater 18 of the thermal cycler 14. Contacts TCA remain open for a time sufficient to allow the pilot flame to extinguish, at which time reclosure of the contacts TCA effects the energization of the pilot valve 12 and of the heater 18 of the thermal cycler 14, and a trial for ignition of the pilot flame is initiated. it is apparent that in the event of a leak condition for the pilot valve, the pilot flame cannot be extinguished by cycling the pilot valve off with the thermal cycler 14, and thus, after the heating time of the warp switch heater 19, the warp switch 15 effects lockout of the system 10.

For a flame condition, the operation of the flame sensing circuit 40 is the same as described above for the condition where the capacitor 34 has been fully charged before the pilot flame was established. That is, the high impedance path, virtually an open circuit, provided between sensing electrode 47 and the reference point 60 when the flame becomes extinguished maintains capacitor 59 discharged and the PUT device 42 is enabled early in each cycle of the AC signal, and at a time before capacitor 49 has charged to a value sufficient to effect the enabling of the silicon controlled rectifier 36.

Accordingly, capacitor 34 is prevented from discharging, and relay R2 becomes deenergized. When relay R2 release, contacts R2C open to deenergize the main valve 13, and contacts R2B close to energize the thermal timer 14 and the warp switch heater 15, and contacts R2A close to reenergize the ignition circuit, and a trial for pilot ignition is initiated as described above.

I claim:

1. In an automatic fuel ignition system including pilot valve means operable when energized during an ignition interval to supply fuel to a pilot fuel outlet for ignition to establish a flame at said pilot outlet, and main valve means operable when energized to supply fuel to a main fuel outlet for ignition by said flame, a control arrangement comprising flame sensing means for sensing the presence of a flame at either one of said fuel outlets, control means operable in the absence of a flame at said pilot fuel outlet during a first duration following the start of the ignition interval to be responsive to said flame sensing means to energize said main valve means when a flame is established at said pilot fuel outlet, said control means maintaining said main valve means deenergized whenever a flame is established at said pilot fuel outlet during said first duration, and delay means operable whenever a flame is provided at said pilot fuel outlet during said first duration to deenergize and reenergize said pilot valve means to thereby interrupt the supply of fuel to said pilot fuel outlet for a predetermined duration, said control means being operable in the event the flame becomes extinguished as the result of operation of said delay means to respond to said flame sensing means to effect energization of said main valve means when a flame is thereafter reestablished at said pilot fuel outlet before the end of said ignition interval.

2. A system as set forth in claim 1 which includes timeout means for defining said ignition interval, said timeout means being controlled by said control means to deactivate the system whenever said control means fails to energize said main valve means during said ignition interval.

3. A system as set forth in claim 1 wherein said delay means is operable when energized to effect the deenergization of said pilot valve means at a predetermined time after said delay means is energized, said control means being operable to prevent operation of said delay means in the absence of flame at said pilot fuel outlet during said first duration.

4. A system as set forth in claim 1 wherein said delay means is operable to cause the flame to be extinguished in the event of a momentary interruption of power to said system which permits the flame to remain established after power is restored, said delay means being ineffective to cause the flame to be extinguished in the event of a leak condition for at least one of said valve means.

5. In an automatic fuel ignition system including activating means responsive to a request signal for activating the system, at least one valve means operable when energized to supply fuel to a fuel outlet for ignition to establish a flame at said outlet, a control arrangement comprising timeout means energized in response to said activating means to define an ignition interval and to deactivate the system at the end of said ignition interval, actuator means energized over said timeout means for energizing said valve means, control means energized by said actuator means to be operable in the absence of a flame at said outlet during a first duration following the start of the ignition interval to deenergize said timeout means when a flame is established at said outlet during said ignition interval to maintain said system activated after said ignition interval, said control means being operable whenever a flame is continuously provided at said outlet for the duration of said ignition interval to maintain said timeout means energized, and to deenergize said timeout means in the event the flame becomes extinguished and reestablished within said ignition interval and prior to the deactivation of the system by said timeout means.

6. A system as set forth in claim 5 which includes delay means operable at a predetermined time after the occurrence of said request signal to deenergize and reenergize said valve means during said ignition interval to thereby interrupt the supply of fuel to said outlet for a predetermined duration.

7. A system as set forth in claim 6 wherein said control means includes further actuator means operable when enabled to deenergize said timeout means and said delay means, flame sensing means responsive to a flame at said outlet to provide a flame signal, and energizing means including timing means and means responsive to said flame signal for permitting said timing means to enable said further actuator means when said flame signal is provided by said flame sensing means after said first duration, and for preventing said timing means from enabling said further actuator means when said flame signal is provided during said first duration.

8. In a automatic fuel ignition system including activating means responsive to a request signal for activating the system to energize at least one valve means for supplying fuel to a fuel outlet for ignition to establish a flame at said outlet, a control arrangement comprising timeout means energized in response to said activating means to define an ignition interval and to deactivate the system at the end of said ignition interval, control means enabled by said activating means to be operable in the absence of a flame at said outlet during a first duration following the start of the ignition interval to deenergize said timeout means when a flame is established at said outlet during said ignition interval to maintain said system activated after said ignition interval, said control means being operable whenever a flame is provided at said outlet during said first duration to maintain said timeout means energized, said delay means operable at a predetermined time after the occurrence of said request signal, said delay means including thermal switch means having heating element means and contact means operated after a predetermined heating time for said heating element means whenever said heating element means is energized to interrupt an energizing path and for valve means to deenergize said valve means for a predetermined duration during said ignition interval to thereby interrupt the supply of fuel to said outlet for said predetermined duration and to reenergize said valve means after said predetermined duration, said control means being operable in the event the flame becomes extinguished as the result of operation of said thermal switch means and is thereafter reestablished prior to the deactivation of the system by said timeout means to deenergize said timeout means.

9. In an automatic fuel ignition system including activating means operable in response to a request signal to energize a pilot valve means for supplying fuel to a pilot fuel outlet during an ignition interval for ignition to establish a pilot flame, and main valve means operable when energized to supply fuel to a main fuel outlet for ignition by the pilot flame, a control arrangement comprising actuator means operable when enabled to energize said main valve means, control means for enabling said actuator means including timing means for delaying the enabling of said actuator means for a first duration following the start of the ignition interval, said control means being operable in the absence of a pilot flame during said first duration to enable said actuator means when a pilot flame is established following said first duration and to maintain said actuator means disabled during said ignition interval when a pilot flame is established during said first duration, and delay means operable when a pilot flame is provided before said actuator means is enabled to deenergize said pilot valve means for a predetermined time to interrupt the supply of fuel to said pilot fuel outlet, said control means being operable in the event the pilot flame is extinguished following the operation of said delay means to enable said actuator means when a pilot flame is thereafter reestablished.

10. A system as set forth in claim 9 wherein said actuator means includes further timing means and switching means enabled by said further timing means in the absence of a pilot flame during said first duration, said timing means of said control means being effective to inhibit said further timing means whenever a pilot flame is established during said first duration to thereby prevent enabling of said switching means.

11. A system as set forth in claim 10 which includes timeout means responsive to said activating means to define said ignition interval and to deactivate the system at the end of said ignition interval, said switching means being operable when enabled to disable said timeout means and said delay means.

12. A system as set forth in claim 9 wherein said activating means includes further actuator means energized in response to said request signal to energize said pilot valve means and said control means, said timing means being operable to maintain said switching means disabled whenever a pilot flame is established when said control means is energized.

13. In an automatic fuel ignition system including activate means for activating the system, and at least one valve means operable when energized to supply fuel to a fuel outlet for ignition to establish a flame at said outlet, a control arrangement comprising timeout means operable when energized to define an ignition interval and to deactivate the system at the end of said ignition interval, control means operable in the absence of a flame at said outlet during a first duration following the start of said ignition interval to override said timeout means when a flame is established at said outlet during said ignition interval, maintaining the system activated after said ignition interval, said control means being prevented from overriding said timeout means whenever a flame is established at said outlet at the start of said ignitionn interval as the result of a leak condition for said valve means, and means operable whenever a flame is established at said outlet at the start of said ignition interval following a momentary deactivation of the system and in the absence of a leak condition for said valve means to cause said control means to override said timeout means, permitting the system to remain activated after said ignition interval.

14. A system as set forth in claim 13 wherein said means for causing said control means to override said timeout means comprises delay means operable at a predetermined time following the start of said ignition interval to deenergize and reenergize said valve means during said ignition interval to thereby interrupt the supply of fuel to said outlet for a predetermined duration.

* * * * *